US005890709A

United States Patent [19]

Phillips

[11] Patent Number: 5,890,709

[45] Date of Patent: Apr. 6, 1999

[54] DOCUMENT PICKER APPARATUS

[75] Inventor: Robert W. Phillips, Waterloo, Canada

[73] Assignee: NCR Corporation, Dayton, Ohio

[21] Appl. No.: 837,256

[22] Filed: Apr. 10, 1997

[51] Int. Cl.[6] ..... B65H 3/04

[52] U.S. Cl. ..... 271/35

[58] Field of Search ..... 271/35, 34, 10.06, 271/119, 146, 166

[56] References Cited

U.S. PATENT DOCUMENTS

| | | | |
|---|---|---|---|
| 3,575,503 | 4/1971 | Vam Auken et al. . | |
| 3,770,162 | 11/1973 | Houghton et al. . | |
| 3,771,783 | 11/1973 | McInerny . | |
| 3,995,851 | 12/1976 | Casper . | |
| 4,122,457 | 10/1978 | Erikson et al. . | |
| 4,884,795 | 12/1989 | VanderSyde . | |
| 4,915,369 | 4/1990 | Rutishauser | 271/35 X |
| 5,000,088 | 3/1991 | Cargill . | |
| 5,115,739 | 5/1992 | Cargill . | |

*Primary Examiner*—David H. Bollinger
*Attorney, Agent, or Firm*—Michael Chan

[57] ABSTRACT

A hopper is located along a document feed path. The hopper stores a stack of documents. A picker wheel has a longitudinal central axis and opposite end portions along the longitudinal central axis. The picker wheel has an outer circumferential surface and is rotatable about its longitudinal central axis. An endless picker belt extends around at least a portion of the outer circumferential surface of the picker wheel. The picker belt has an endless outer surface which is engageable with a document in the stack of documents to move the document along the document feed path. A pair of jogging devices is disposed at the opposite end portions of the picker wheel. The jogging devices jog the stack of documents while the outer surface of the picker belt is engaging a document in the stack of documents to move the document along the document feed path.

6 Claims, 4 Drawing Sheets

DOCUMENT PICKER APPARATUS

BACKGROUND OF THE INVENTION

The present invention relates to document feeding along a document feed path, and is particularly directed to a document picker apparatus for picking a document from a stack of documents stored in a hopper of a document processing system such as a check processing system.

A known type of document picker apparatus for picking a document from a stack of documents includes a picker wheel which is rotatable about its longitudinal central axis. When the picker wheel is driven to rotate about its longitudinal central axis, a picker belt disposed on the picker wheel is driven. The picker belt has an outer major side surface which engages documents from a stack of documents stored in a hopper. When the picker belt is driven, the outer major side surface of the picker belt picks documents from the stack of documents and moves these documents along a document feed path.

An advance/retard mechanism cooperates with the picker wheel to separate adjacent documents from each other as documents are picked and moved along the document feed path. A typical advance/retard mechanism holds a document which is being picked by the picker wheel stationary while advancing a document which is ahead of the document being held stationary. The document being held stationary continues to be held until the document which is being advanced is moved sufficiently along the document feed path to separate away from the document being held stationary.

From time to time, a document may buckle like an accordion in the document feed path. This may occur because the picker wheel is tending to force the document along the document feed path while the advance/retard mechanism is tending to hold the document stationary until it and the document ahead are separated from each other along the document feed path.

SUMMARY OF THE INVENTION

In accordance with one aspect of the present invention, a document picker apparatus is provided for moving documents from a stack of documents stored in a hopper along a document feed path. The document picker apparatus comprises a picker wheel having a longitudinal central axis and opposite end portions along the longitudinal central axis. The picker wheel has an outer circumferential surface and is rotatable about its longitudinal central axis. An endless picker belt extends around at least a portion of the outer circumferential surface of the picker wheel. The picker belt has an endless outer surface which is engageable with a document in the stack of documents to move the document along the document feed path. A first jogging device is disposed at one end portion of the picker wheel. The first jogging device is provided for jogging the stack of documents while the outer circumferential surface of the picker belt is engaging a document in the stack of documents to move the document along the document feed path.

Preferably, the first jogging device includes a flange having at least one lobe which jogs the stack of documents when the lobe engages a document from the stack of documents. A second jogging device is disposed at the other end portion of the picker wheel. The second jogging device includes a flange having at least one lobe which jogs the stack of documents when the lobe engages a document from the stack of documents. The endless picker belt is positioned between the first and second jogging devices. Each flange comprises stainless steel material.

In accordance with another aspect of the present invention, an apparatus comprises means defining a document feed path. A hopper is located along the document feed path and is provided for storing a stack of documents. A picker wheel has a longitudinal central axis and opposite end portions along the longitudinal central axis. The picker wheel has an outer circumferential surface and is rotatable about its longitudinal central axis. An endless picker belt extends around at least a portion of the outer circumferential surface of the picker wheel. The picker belt has an endless outer surface which is engageable with a document in the stack of documents to move the document along the document feed path. A first jogging device is disposed at one end portion of the picker wheel. The first jogging device is provided for jogging the stack of documents while the outer circumferential surface of the picker belt is engaging a document in the stack of documents to move the document along the document feed path.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
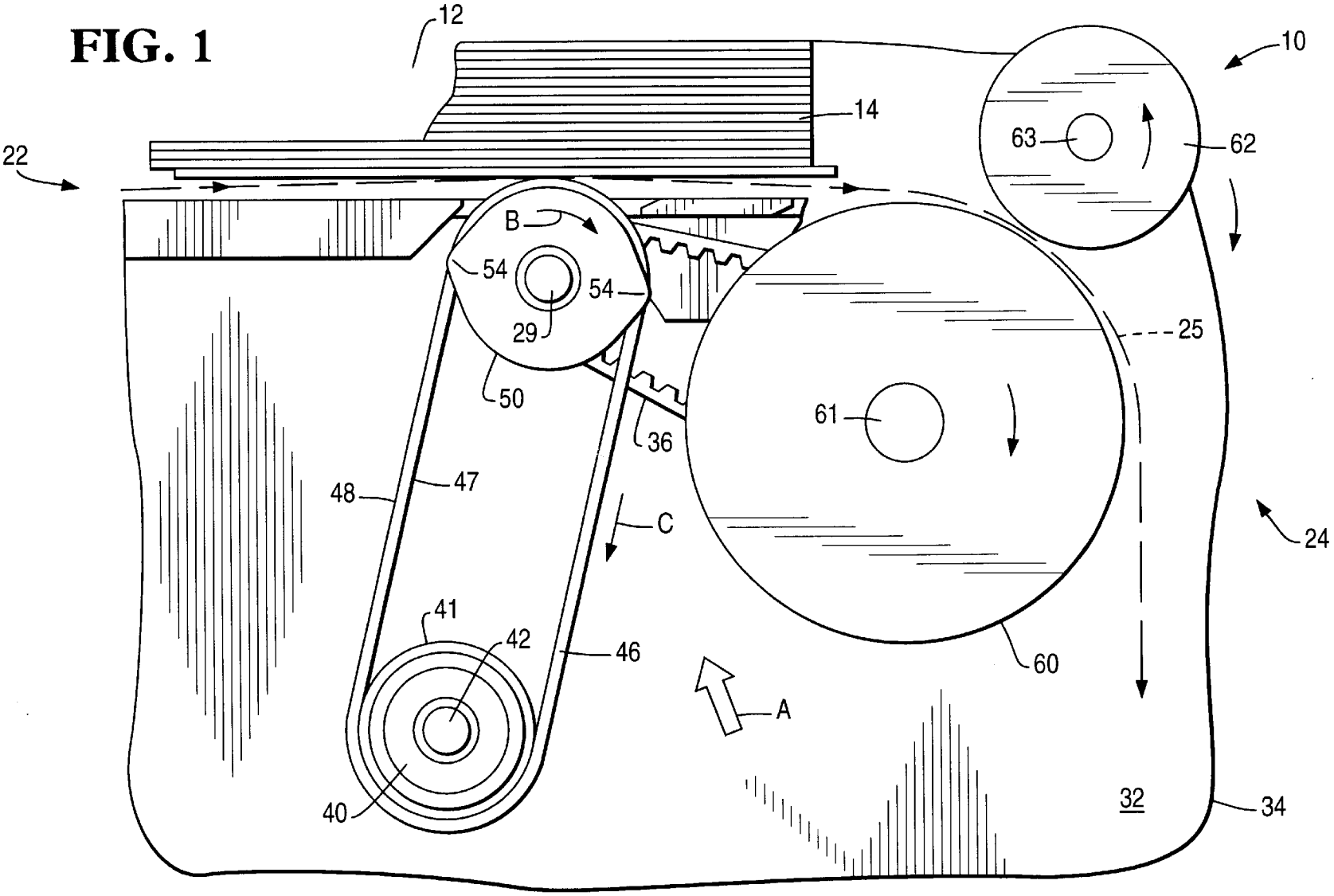
FIG. 1 is a plan view of a document processing system embodying a document picker apparatus constructed in accordance with the present invention.
Figure 2:
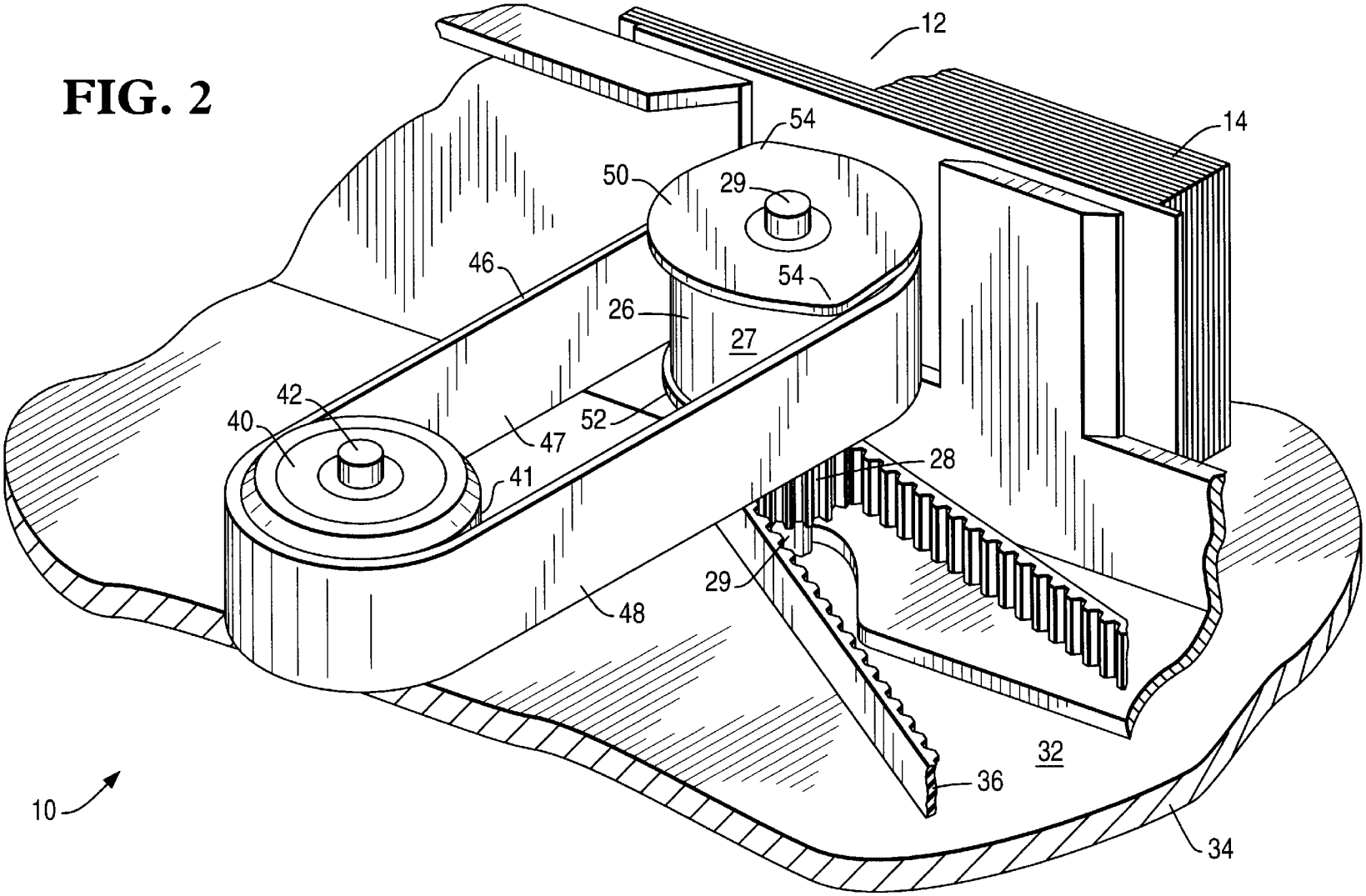
FIG. 2 is a perspective view looking approximately in the direction of arrow A in FIG. 1.

The present invention is directed to a document picker apparatus for picking a document from a stack of documents stored in a hopper and moving the picked document along a document feed path. The specific use and construction of a document picker apparatus in accordance with the present invention may vary. By way of example as shown in FIGS. 1 and 2, a document picker apparatus constructed in accordance with the present invention is embodied in a document processing system 10 such as a bank check processing system.

The document processing system 10 has an upstream end 22, a downstream end 24, and a document feeding path 25 (shown in dashed lines in FIG. 1) defined between the upstream end 22 and the downstream end 24. A hopper 12 containing a stack 14 of documents is located along and above the document feeding path 25.

A picker wheel 26 (FIG. 2) having an outer circumferential surface 27 is fixedly attached to a toothed wheel 28. The toothed wheel 28 is fixedly attached to a drive shaft 29 which extends through a mounting surface 32 of a base plate 34. The drive shaft 29 is drivingly connected to a suitable drive motor (not shown). When the toothed wheel 28 is driven by the motor to rotate about its longitudinal central axis, the picker wheel 26 rotates about its longitudinal central axis.

An idler wheel 40 having an outer circumferential surface 41 is rotatably mounted on a pivot post 42 which is fixedly attached to the mounting surface 32 of the base plate 34. An endless drive belt 46 extends around the picker wheel 26 and the idler wheel 40. The belt 46 has an inner major side surface 47 and an outer major side surface 48. When the picker wheel 26 is driven to rotate about its longitudinal central axis in the direction of arrow "B" shown in FIG. 1, the belt 46 is driven to move in the direction of arrow "C" shown in FIG. 1. While the belt 46 is being driven, the outer major side surface 48 of the belt 46 engages a number of documents from the stack 14 of documents stored in the hopper 12 and moves the engaged documents along the document feed path 25.

An advance roller 60 (FIG. 1) is located along one side of the document feed path 25 and downstream from the picker wheel 26. A retard roller 62 is located along the other side of the document feed path 25 opposite the advance roller 60 and also downstream from the picker wheel 26. Accordingly, the document feed path 25 extends between the advance roller 60 and the retard roller 62.

The advance roller 60 is fixedly attached to a toothed wheel (not shown) which is rotatably mounted on a pivot post 61 fixedly attached to the mounting surface 32 of the base plate 34. The retard roller 62 is fixedly attached to a drive shaft 63 which extends through the mounting surface 32 of the base plate 34. The drive shaft 63 is connected to a suitable drive motor (not shown) which drives the retard roller 62 for rotation in the direction of the arrow shown in the retard roller of FIG. 1.

An endless toothed timing belt 36 is operatively coupled in a known way between the toothed wheel 28 and the toothed wheel which is fixedly attached to the advance roller 60. When the picker wheel 26 rotates about its longitudinal central axis in the direction of arrow "B" shown in FIG. 1, the advance roller 60 rotates in the direction of the arrow shown in the advance roller of FIG. 1. The outer circumferential surface of the advance roller 60 in the vicinity of the document feed path 25 moves at a speed higher than the speed at which outer circumferential surface of the retard roller 62 in the vicinity of the document feed path moves.

The advance roller 60 and the retard roller 62 comprise an advance/retard mechanism which holds a document which is being picked by the belt 46 while advancing a document which is ahead of the document being held stationary. The document being held stationary continues to be held until the document which is being advanced is moved sufficiently along the document feed path 25 to separate away from the document being held stationary. The structure and operation of the advance/retard mechanism are well known and, therefore, will not be described in further detail.

In accordance with the present invention, a jogging device 50 is disposed at one end portion of the picker wheel 26 and another jogging device 52 is disposed at the other end portion of the picker wheel. The structure and operation of the jogging device 50 are the same as the structure and operation of the jogging device 52. For simplicity, the structure and operation of the jogging device 50 are described in detail.

The jogging device 50 comprises a flange having a pair of lobes 54 which lie opposite each other. While the picker wheel 26 is rotating about its longitudinal central axis to drive the belt 46, the lobes 54 engage documents which are being moved by the belt 46 along the document feed path 25. Each time a lobe engages a document which is being moved by the belt 46 along the document feed path 25, the entire stack 14 of documents is pushed upwards slightly away from the outer major side surface 48 of the belt 46. The stack 14 of documents is pushed upwards for only a relatively short period of time. The duration of this period of time depends upon the actual shape and size, for example, of the lobes 54. Preferably, the jogging device 50 comprises relatively low friction material that exhibits good wear characteristics, such as stainless steel.

Figure 3:
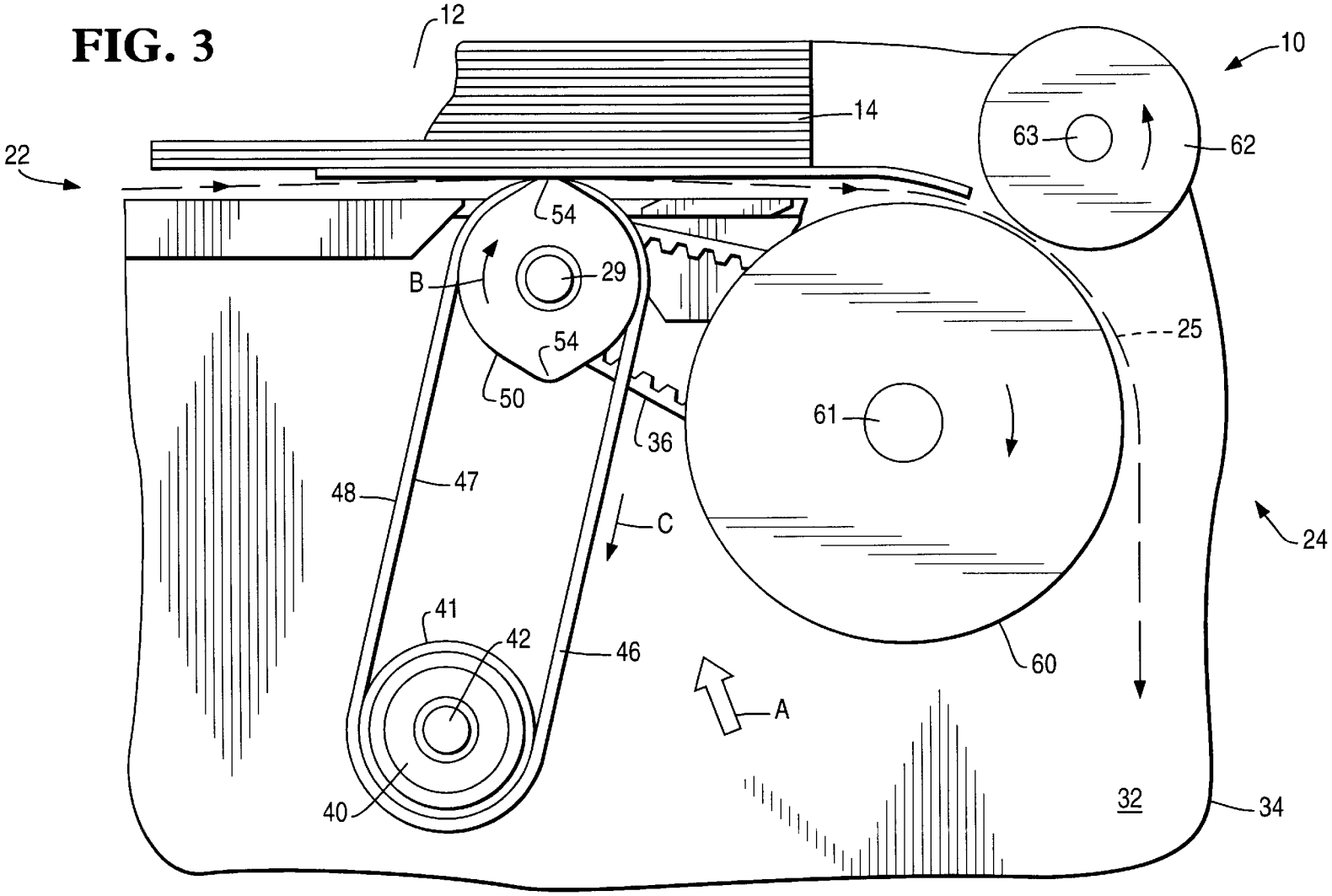
FIGS. 3 and 4 are views similar to FIG. 1 and showing parts in different positions.

More specifically, during rotation of the picker wheel 26 about its longitudinal central axis, the jogging device 50 moves from a position such as shown in FIG. 1 to a jogging position as shown in FIG. 3 to lift the stack 14 slightly upwards away from the outer major side surface 48 of the belt 46. When the jogging device 50 is in the jogging position shown in FIG. 3, the documents contained in the stack 14 are loosened. When this occurs, there is a relatively lower contact pressure between the bottom-most document in the stack 14 and its adjacent document in the stack.

Figure 4:
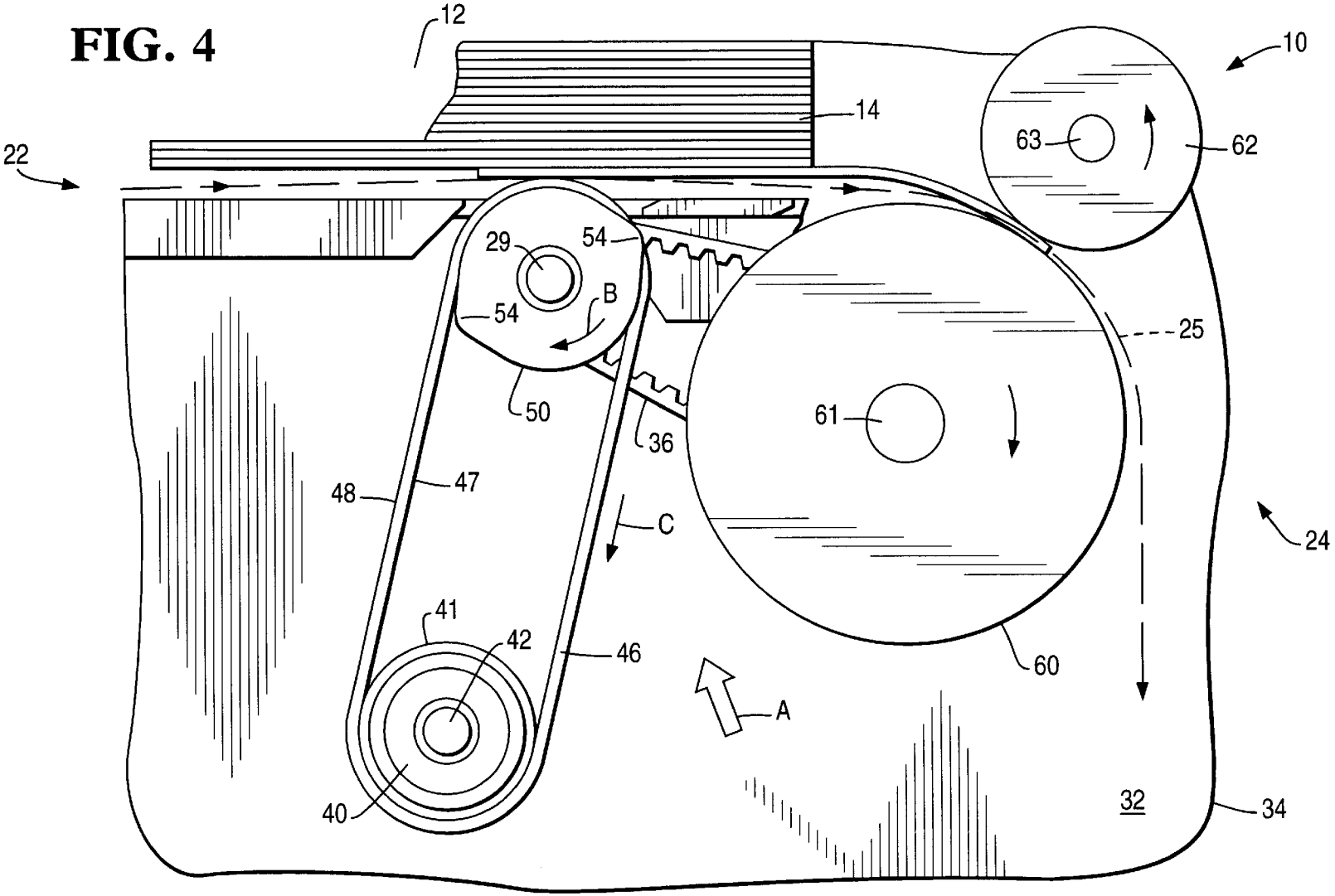

As the picker wheel 26 continues to rotate about its longitudinal central axis, the jogging device 50 moves from the jogging position shown in FIG. 3 to a position such as shown in FIG. 4 to allow the bottom-most document in the stack 14 to move into contact with the outer major side surface 48 of the belt 46. The bottom-most document moves into contact with the outer major side surface 48 of the belt 46 while there is still the relatively lower contact pressure between the bottom-most document and its adjacent document in the stack 14. Accordingly, a relatively lower picking force is applied by the outer major side surface 48 of the belt 46 to pick the bottommost document in the stack 14.

It should be apparent that each of the lobes 54 of the jogging device 50 intermittently jogs the stack 14 of documents as the picker wheel 26 rotates about its longitudinal central axis. The other jogging device 52 located at the other end of the picker wheel 26 comprises a flange having lobes identical to the lobes 54 of the jogging device 50 as just described hereinabove. The endless picker belt 46 is therefore positioned between the jogging devices 50, 52. Preferably, the lobes of the jogging devices 50, 52 are positioned relative to each other such that a lobe from one jogging device jogs the stack 14 at the same time a lobe from the other jogging device jogs the stack. The jogging action from the jogging devices 50, 52 loosens the documents contained in the stack 14 while documents are being picked from the stack.

A number of advantages result by providing the jogging devices 50, 52 in accordance with the present invention for jogging the stack 14 of documents. One advantage is that the tendency of picking and moving more than one document (i.e., a double item feed condition) along the document feed path 25 is reduced. The tendency of a double item feed condition to occur is reduced because the normal force applied by the rest of the stack 14 against the bottom-most document being picked is reduced when lobes of the jogging devices 50, 52 engage the document being picked and lift the stack.

Another advantage is that the tendency of a relatively light weight document (i.e., a document having relatively low stiffness) to buckle like an accordion while the document is being picked is reduced. The tendency of the document to buckle is reduced because the document is allowed to recover from its tendency to buckle when the picking force applied to the document is intermittently reduced as a result of the jogging action applied to the stack 14. Accordingly, the tendency of the document to fold, wrinkle, or jam in the document feed path 25 is reduced.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. A document picker apparatus for moving documents from a stack of documents stored in a hopper along a document feed path, the document picker apparatus comprising:

a picker wheel having a longitudinal central axis and opposite end portions along the longitudinal central axis, the picker wheel having an outer circumferential surface and being rotatable about its longitudinal central axis;

an endless picker belt extending around at least a portion of the outer circumferential surface of the picker wheel, the picker belt having an endless outer surface which is engageable with a document in the stack of documents to move the document along the document feed path;

a first jogging device disposed at one end portion of the picker wheel and for jogging the stack of documents while the outer circumferential surface of the picker belt is engaging a document in the stack of documents to move the document along the document feed path, the first jogging device including a flange having at least one lobe which jogs the stack of documents when the lobe engages a document from the stack of documents; and a second jogging device disposed at the other end portion of the picker wheel, the second jogging device including a flange having at least one lobe which jogs the stack of documents when the lobe engages a document from the stack of documents.

2. A document picker apparatus according to claim 1, wherein the endless picker belt is positioned between the first and second jogging devices.

3. A document picker apparatus according to claim 1, wherein each flange comprises stainless steel material.

4. An apparatus comprising:

means defining a document feed path;

a hopper located along the document feed path and for storing a stack of documents;

a picker wheel having a longitudinal central axis and opposite end portions along the longitudinal central axis, the picker wheel having an outer circumferential surface and being rotatable about its longitudinal central axis;

an endless picker belt extending around at least a portion of the outer circumferential surface of the picker wheel, the picker belt having an endless outer surface which is engageable with a document in the stack of documents to move the document along the document feed path;

a first jogging device disposed at one end portion of the picker wheel and for jogging the stack of documents while the outer circumferential surface of the picker belt is engaging a document in the stack of documents to move the document along the document feed path, the first jogging device including a flange having at least one lobe which jogs the stack of documents when the lobe engages a document from the stack of documents; and a second jogging device disposed at the other end portion of the picker wheel, the second jogging device including a flange having at least one lobe which jogs the stack of documents when the lobe engages a document from the stack of documents.

5. An apparatus according to claim 4, wherein the endless picker belt is positioned between the first and second jogging devices.

6. An apparatus according to claim 4, wherein each flange comprises stainless steel material.

* * * * *